United States Patent [19]

Silvestri, Jr.

[11] 4,099,385

[45] Jul. 11, 1978

[54] EXTENDED FUEL CYCLE OPERATION FOR PRESSURIZED WATER REACTOR PLANTS

[75] Inventor: George J. Silvestri, Jr., Morton, Pa.

[73] Assignee: Westinghouse Electric Corp., Pittsburgh, Pa.

[21] Appl. No.: 653,174

[22] Filed: Jan. 28, 1976

[51] Int. Cl.[2] ..... F01K 7/34; G21C 9/00

[52] U.S. Cl. ..... 60/678; 176/38; 176/55; 176/60

[58] Field of Search ..... 176/55, 37, 56, 38, 176/60; 60/678, 682

[56] References Cited

U.S. PATENT DOCUMENTS

| | | | |
|---|---|---|---|
| 3,061,533 | 10/1962 | Shannon et al. | 176/56 X |
| 3,247,069 | 4/1966 | Powell et al. | 176/20 |
| 3,575,807 | 4/1971 | Ripley | 176/56 |
| 3,625,817 | 12/1971 | Anderson | 176/38 |
| 3,630,839 | 12/1971 | Podolsky | 176/24 |

FOREIGN PATENT DOCUMENTS

| | | | |
|---|---|---|---|
| 550,827 | 4/1932 | Fed. Rep. of Germany | 60/678 |
| 1,058,264 | 2/1967 | United Kingdom | 60/678 |

*Primary Examiner*—Verlin R. Pendegrass
*Assistant Examiner*—Ralph Palo
*Attorney, Agent, or Firm*—J. W. Keen

[57] ABSTRACT

A nuclear steam turbine power plant system having an arrangement therein for extended fuel cycle operation. The power plant includes a turbine connected at its inlet to a source of motive fluid having a predetermined pressure associated therewith. The turbine has also connected thereto an extraction conduit which extracts steam from a predetermined location therein for use in an associated apparatus. A bypass conduit is provided between a point upstream of the inlet and the extraction conduit. A flow control device is provided within the bypass conduit and opens when the pressure of the motive steam supply drops beneath the predetermined pressure as a result of reactivity loss within the nuclear reactor. Opening of the bypass conduit provides flow to the associated apparatus and at the same time provides an increased flow orifice to maintain fluid flow rate at a predetermined level.

7 Claims, 1 Drawing Figure

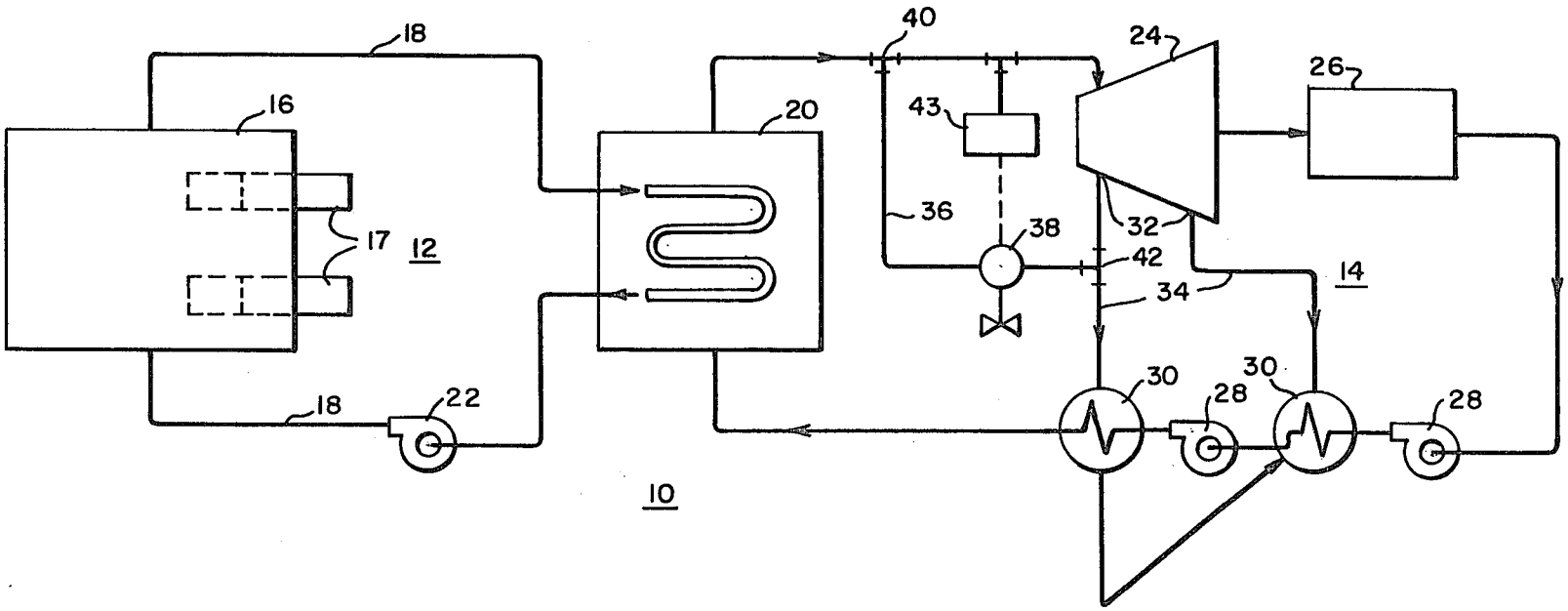
10
12
14
16
17
18
18
20
22
24
26
28
28
30
30
32
34
36
38
40
42
43

EXTENDED FUEL CYCLE OPERATION FOR PRESSURIZED WATER REACTOR PLANTS

BACKGROUND OF THE INVENTION

1. Field of the Invention

This invention relates to steam turbine power plants, and in particular, to an arrangement for operation of a pressurized water reactor power plant during extended fuel cycle operation.

2. Description of the Prior Art

A typical nuclear steam power plant comprises an interconnected arrangement of two loops; one loop comprising a primary, or nuclear, side, with the other comprising a secondary, or steam, side. The primary side includes a nuclear reactor element and a steam generator element, and a closed conduit arrangement carrying therein a pressurized coolant which passes through both the reactor and the steam generator element. The steam side comprises a series-connected arrangement including the steam generator element, a high-pressure and a low-pressure turbine, a condenser, and a bank of feedwater heaters.

In operation, the pressurized fluid coolant within the conduits of the primary loop takes the heat produced by reactions within the reactor core and transfers that heat within the steam generator element to boiler feedwater, which is, in turn, raised in temperature and converted to steam. The steam exits the steam generator element and is permitted to expand through both the high- and low-pressure turbines. The expanding steam acts against rotating elements within the turbines and converts the pressure energy of the steam to rotational mechanical energy. After expansion, the steam is condensed within the condenser and conducted back to the steam generator element. Each of the plurality of feedwater heaters raise the temperature of the feedwater prior to its reintroduction into the steam generator element.

In general, it is known that for the steam side, the work produced thereby is equal to the product of the amount of heat added multiplied by a factor known as conversion efficiency. Symbolically, this is indicated by the relation $$W = (Q_a)(N)$$

It is also known that the amount of heat added, $Q_a$, is equal to the mass flow rate, G, multiplied by the energy added per pound of fluid, $\Delta h$. Further, it is known that N, the conversion efficiency, is a function of the final feed temperature.

After the reactor has been operating for a considerable period of time and the control rods therein have been extracted to their fullest extent, the throttle pressure of the steam entering the steam side begins to decrease. Thus, for a given size orifice within the high-pressure turbine, the flow therethrough decreases due to the decrease in the throttle pressure. As the throttle pressure decreases, G (the mass flow) decreases, and, therefore, the amount of heat added, $Q_a$, decreases, leading to a concomitant decrease in the work output.

The prior art, especially that shown in the copending Buscemi, Nusbaum and Silvestri application, Ser. No. 419,746, filed Nov. 28, 1973 and assigned to the assignee of this invention, attempts to increase the reactivity levels within the reactor at "stretch-out" (that is, after the full extraction of all control rods) through several schemes. One such scheme is to increase the mass flow by completely bypassing the high-pressure element. An alternative scheme is to lower the temperature level of the final feed by either individually or collectively closing the extractions from the turbine elements to the feedwater heaters, or, alternatively, shunting any or all of the individual heaters. In this way, since $\Delta h$, dependent upon final feed temperature, increases, $Q_a$ also increases.

However, from the work output standpoint, the expedient of the above-mentioned application which increases mass flow has the effect of decreasing work output because it bypasses the high-pressure turbine. Also, the expedients which shunted feedwater heaters resulted in a decrease in conversion efficiency since the temperature of the final feed decrease. Applicant in his invention described herein is able to accommodate both an increase in the amount of heat added to the system ($Q_a$) and also contemporaneously maintain a high conversion efficiency (N).

SUMMARY OF THE INVENTION

The invention includes a bypass conduit having a flow control device therein disposed between a point upstream of the inlet to a turbine apparatus and an extraction conduit taking steam from a predetermined location within the turbine to an associated user apparatus. The flow control device is actuated when the pressure of the steam from the motive steam source of the turbine element decreases below a predetermined pressure level indicative of the loss in throttle pressure occasioned by the decrease in reactivity within the reactor element.

The bypass conduit acts as an increased flow orifice so as to maintain the mass flow rate of steam into the steam system. Further, the conversion efficiency of the steam side is maintained since the temperature of the feedwater, as raised by the associated apparatus, is maintained. Also, work output increases since steam which would have been extracted from the turbine element to supply the associated apparatus is permitted to expand through the turbine.

It is an object of this invention to provide an arrangement wherein the work output of the turbine power plant is maintained for a predetermined period of time following the onset of reactivity decrease within the reactor element. It is an object of this invention to provide a flow arrangement which maintains both the flow rate of the system and the temperature of the final feed after the initiation of reactivity decrease within the reactor. Other objects of the invention will be seen from the following description of the preferred embodiment which follows herein.

BRIEF DESCRIPTION OF THE DRAWING

The invention will be more fully understood from the following detailed description of the preferred embodiment, taken in connection with the accompanying drawing, in which:

The FIGURE is a diagrammatic illustration of a steam turbine power plant embodying the teachings of this invention.

DESCRIPTION OF THE PREFERRED EMBODIMENT

Referring to the FIGURE, a diagrammatic illustration of a nuclear steam turbine power plant embodying the teachings of this invention is shown.

The plant 10 comprises an interconnected loop arrangement having a primary, or reactor loop 12 and a secondary or steam loop 14.

The primary, or reactor loop 12, includes a nuclear element 16 having control rods 17 therein and connected by suitable conduit arrangements 18 to the steam generator element 20. The conduit 18 contains a water coolant which is pumped under pressure by pump 22 and flows through the reactor 16 to take the heat produced therein and transfer that heat to feedwater within the steam generator 20 to raise thereby the temperature of the feedwater and convert it to steam.

The secondary, or steam side 14, comprises a series connection including the steam generator element 20 which acts as a source of high-pressure and high temperature motive fluid for a steam turbine element 24. The turbine 24 is in turn connected to a condenser 26 where steam exhausted from the turbine 24 returns to the liquid state. This feedwater is then pumped by suitable pump 28 through a series of feedwater heaters 30 which raises the temperature of the feedwater prior to its reintroduction into the steam generator element 20. Supplying heat to the feedwater heater 30 is steam taken from an extraction point 32 within the turbine 24 by an extraction conduit 34.

Applicant's invention disposes a bypass conduit 36 having a flow control device 38 disposed therein between a point 40 upstream of the inlet of the turbine element 24 to a point 42 within the extraction conduit 34. During normal operation of the power plant 10, that is, before the control rods 17 have been fully retracted from their position within the reactor 16, the bypass valve 38 occupies the fully seated position.

At the end of the normal fuel cycle, that is, when the control rods 17 have been completely extracted from the reactor 16, the throttle pressure of the steam entering the steam side 14 from the steam generator 20 decreases. As a result, the mass flow rate of fluid in the steam side 14 also decreases. As explained earlier, since the mass flow rate decreases, the amount of heat added, $Q_a$, into the steam loop 14 decreases, thus decreasing the work output thereof. In such a situation, it is applicant's invention to open the control valve 38 when the pressure upstream of the inlet turbine 24 decreases below the normal pressure value to thereby open the bypass valve 38 and initiate flow between the points 40 and 42. The valve 38 may be opened by a control arrangement 43, such as a pressure transducer connected to the valve actuator, which opens the valve 38 when the pressure at the turbine inlet (or immediately upstream thereof) drops below its predetermined value. Such a solution has the advantage of maintaining the mass flow rate into the steam side 14 at a predetermined value, yet at the same time, maintains the temperature of the final feedwater entering the steam generator 20 to thereby maintain the conversion efficiency N of the steam side 14.

The effect of opening the control valve 38 is to make it appear, relative to the steam generator element 20, that a larger flow orifice has been provided and therefore, the flow rate into the steam side 14 is maintained at a constant level. Next, by providing a flow into the feedwater heater 30, the temperature of the final feed is not diminished as in the case of some prior art solutions. Therefore, the temperature of the final feedwater is not diminished and the conversion efficiency of the steam side 14 remains high. Also, by providing flow from upstream of the turbine 24 inlet to the extraction conduit 34, steam which would have normally been extracted from the turbine at point 32 is permitted to expand through the rest of the turbine to thus increase the work output thereof. It is the increase in flow downstream of the extraction orifice 32 which increases the work produced by the steam side 14 when using applicant's system. As a further advantage, it is possible that flow bifurcation can occur at point 42 so that in addition to supplying the steam requirements for the feedwater heater 30, a portion of the throttle steam will flow from point 42 into the turbine 24 to further augment the work output thereof.

As stated previously, the invention described herein is utilized only during the fuel extension cycle before the implementation of the schemes described in the above-cited copending application to Nusbaum, Buscemi and Silvestri. Since this is the case, the efficacy of the schemes there disclosed remains unchanged. Since the conversion efficiency is maintained during implementation of the teachings of this invention, this invention is a more attractive initial step at the onset of extended fuel cycle operation than the Buscemi, Nusbaum, Silvestri alternative. However, since the conversion efficiency of applicant's arrangement is lower than the conversion efficiency during the normal fuel cycle, the alternative of the arrangement described herein is not implemented during normal operation. The normal output of the steam generator, relative to the turbine inlet, is equal to the sum of the flow through the turbine inlet plus the flow through the bypass conduit to the extraction.

I claim as my invention:

1. A power plant comprising:

a source of motive fluid having a predetermined pressure associated therewith, a turbine element having an inlet and an outlet end, said inlet end being in fluid communication with said motive fluid source, a heat rejection element for liquefying said motive fluid to condensate, said heat rejection element being in fluid communication with said turbine's outlet end, a heat recovery element for heating the condensate and passing it therethrough to said motive fluid source;

an extraction conduit connected at a first end to a predetermined point within said turbine between said inlet and said outlet ends and at a second end to the heat recovery element, a bypass conduit disposed so as to provide fluid communication between said motive fluid source and said extraction conduit, a flow control device for regulating fluid flow through said bypass conduit, and, means for opening said flow control device in response to said motive fluid's pressure dropping a predetermined amount below said motive fluid's predetermined pressure causing motive fluid flow through said bypass conduit whereby a first portion of said bypassed motive fluid can be supplied to the turbine element through the extraction conduit while a second portion of said bypassed motive fluid can be routed to said heat recovery element.

2. The power plant of claim 1, said heat recovery element comprising:

a feedwater heater.

3. The power plant of claim 1, said heat rejection element comprising:

a condenser.

4. The power plant of claim 1, wherein said extraction conduit is capable of transmitting fluid therethrough to said second end while permitting fluid flow both to and from said first end.

5. A method for operating a power plant having a turbine apparatus which receives motive fluid through an inlet from a motive fluid source and exhausts that fluid through an outlet into a condensing apparatus where it is liquefied to a condensate and returned to the motive fluid source via a heat recovery apparatus which is in fluid communication through an extraction conduit with a predetermined point between said turbine's inlet and outlet, said method comprising: monitoring the pressure of the motive fluid prior to its entry into the turbine; and allowing fluid flow through a bypass conduit which fluidly connects the motive fluid source and extraction conduit in response to a decrease in the monitored pressure below a predetermined value.

6. The method of claim 5, wherein said fluid flow, once initiated through said bypass conduit, is progressively increased as the monitored pressure decreases below the predetermined value.

7. The method of claim 5, wherein fluid flow through the bypass conduit is allowed by opening a flow control device which is disposed in the bypass conduit.

* * * * *